US007455013B2

(12) United States Patent
Simske et al.

(10) Patent No.: US 7,455,013 B2
(45) Date of Patent: Nov. 25, 2008

(54) SECURE PRINTING METHOD TO THWART COUNTERFEITING

(75) Inventors: Steven J. Simske, Fort Collins, CO (US); Jordi Arnabat Benedicto, Tarragona (ES); Oscar Martinez Bailac, Castelldefels (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 501 days.

(21) Appl. No.: 11/076,533

(22) Filed: Mar. 8, 2005

(65) Prior Publication Data

US 2006/0201364 A1 Sep. 14, 2006

(51) Int. Cl.
*B42D 15/00* (2006.01)
*B41F 33/00* (2006.01)

(52) U.S. Cl. ..... 101/483; 283/72; 283/93; 283/902; 422/7; 422/55

(58) Field of Classification Search ..... 283/74, 283/57–59, 72, 91, 93, 902; 422/55; 427/7
See application file for complete search history.

(56) References Cited

U.S. PATENT DOCUMENTS

| | | | | |
|---|---|---|---|---|
| 4,856,820 | A | 8/1989 | Kasprzak | |
| 4,896,029 | A | 1/1990 | Chandler et al. | |
| 4,924,078 | A | 5/1990 | Sant' Anselmo et al. | |
| 5,018,767 | A * | 5/1991 | Wicker | 283/67 |
| 5,288,986 | A | 2/1994 | Pine et al. | |
| 5,296,693 | A | 3/1994 | Hughes-Hartogs | |
| 5,449,200 | A | 9/1995 | Andric et al. | |
| 5,464,974 | A | 11/1995 | Priddy et al. | |
| 5,726,435 | A | 3/1998 | Hara et al. | |
| 5,904,375 | A | 5/1999 | Brugada | |
| 5,915,731 | A * | 6/1999 | Jackson | 283/91 |
| 6,030,657 | A | 2/2000 | Butland et al. | |
| 6,039,357 | A * | 3/2000 | Kendrick | 283/93 |
| 6,070,805 | A | 6/2000 | Kaufman et al. | |
| 6,139,066 | A | 10/2000 | Mowry, Jr. et al. | |
| 6,141,441 | A | 10/2000 | Cass et al. | |
| 6,214,766 | B1 | 4/2001 | Kurrie | |
| 6,402,986 | B1 | 6/2002 | Jones, II et al. | |
| 6,606,396 | B1 | 8/2003 | Isibashi et al. | |
| 6,678,412 | B1 | 1/2004 | Shigekusa et al. | |
| 6,701,304 | B2 * | 3/2004 | Leon | 705/401 |
| 6,706,314 | B2 | 3/2004 | Butland | |
| 6,753,989 | B2 * | 6/2004 | Holmes et al. | 359/2 |
| 6,776,340 | B2 | 8/2004 | Murokh et al. | |
| 6,793,138 | B2 | 9/2004 | Saito | |
| 7,074,478 | B2 * | 7/2006 | Abraham | 428/209 |
| 2004/0023397 | A1 | 2/2004 | Vig Rakesh et al. | |

FOREIGN PATENT DOCUMENTS

| | | |
|---|---|---|
| EP | 1178429 | 2/2002 |
| EP | 1318486 | 6/2003 |
| EP | 1443452 | 4/2004 |
| FR | 2855640 | 12/2004 |
| WO | 91/11331 | * 8/1991 |
| WO | 9912742 | 3/1999 |
| WO | WO 01/80169 | 10/2001 |
| WO | WO 2004089640 | 10/2004 |

OTHER PUBLICATIONS

International Search Report for Application No. PCT/US2006/007587. Report issued Jul. 13, 2007.

* cited by examiner

*Primary Examiner*—Daniel J Colilla
*Assistant Examiner*—Marissa L Ferguson-Samreth

(57) ABSTRACT

A method for implementing a secure printing campaign to thwart counterfeiting is provided. The method includes the steps of selecting a first secure print technology and a second secure print technology that is distinct from the first secure print technology, selecting a first secure print variable for the first secure print technology and a second secure print variable for the second secure print technology, and establishing a first plurality of discrete values for the first secure print variable and a second plurality of discrete values for the second secure print variable.

20 Claims, No Drawings

SECURE PRINTING METHOD TO THWART COUNTERFEITING

FIELD OF THE INVENTION

The present invention relates generally to secure printing technologies. More particularly, the present invention relates to secure printing technologies to thwart counterfeiting activities.

BACKGROUND OF THE INVENTION

Product counterfeiting is a problem of enormous proportions throughout most of the industrialized world. In many cases, products that appear to be branded by a particular company are in fact counterfeited imitations. Brands that appear on products serve to provide consumers with information regarding the source of the goods in question. Subsequently, consumers develop preferences for particular brands, which often may include a level of trust in the source of the products. Counterfeiters take advantage of this preference and trust to pass off what are often inferior goods, causing harm to both the manufacturer and the consumer. Manufacturers lose revenue from lost sales and any goodwill harm that occurs, and consumers lose value due to inferior products that may potentially cause harm through defects.

As an example, the pharmaceutical industry generates many billions of dollars in the United States each year. Given such a lucrative market, it is not surprising that counterfeiting of pharmaceuticals has become a widespread and rapidly growing problem. Several factors appear to contribute to this alarming growth of criminal activity, including the increased involvement of under-regulated wholesalers and repackagers in the drug supply chain; the recent growth of internet pharmacies; and the increased international importation of pharmaceuticals. As such, consumers of pharmaceuticals may be unaware that the drugs they are taking may not have been manufactured and packaged as indicated on the pharmaceutical packaging.

Such counterfeiting practices not only reduce income to pharmaceutical companies, but they also introduce potential health risks to the consumers of the drugs in question. The strict regulation process imposed on pharmaceutical companies by the FDA helps to ensure the quality and safety of a drug. Consumers purchasing imported counterfeit drugs may believe they are taking a pharmaceutical medicine that has been manufactured and distributed according to these strict FDA guidelines and thus be effective and safe, when in fact the drug may be ineffective or may cause potentially dangerous side-effects. When health risks come to fruition in these cases, consumers have no recourse or remedy due to the illicit nature of parties providing the counterfeits.

One significant technological development that has contributed significantly to the rapid spread of most forms of product counterfeiting is the widespread availability of high quality yet relatively inexpensive scanners, photo printers, and image editing software. It takes little skill for a counterfeiter to scan a product label, edit the resulting image to suit a particular need, and print a supply of counterfeit labels.

As such, it would be beneficial to provide a method for increasing the difficulty of producing counterfeited products for criminal that lack a high level of technological expertise. Additionally, by increasing the level of counterfeiting difficulty, it is hoped that even highly skilled criminals will lack the resources to create illicit merchandise.

SUMMARY OF THE INVENTION

It has been recognized that it would be advantageous to provide a method for thwarting the production of counterfeit products. Specifically, a method for implementing a secure printing campaign to thwart counterfeiting is provided. The method includes the steps of selecting a first secure print technology and a second secure print technology that is distinct from the first secure print technology, selecting a first secure print variable for the first secure print technology and a second secure print variable for the second secure print technology, and establishing a first plurality of discrete values for the first secure print variable and a second plurality of discrete values for the second secure print variable.

Another embodiment of the present invention provides a method for implementing a secure printing campaign to thwart counterfeiting including steps of selecting three or more secure print technologies, selecting at least one secure print variable for each of the secure print technologies, and establishing a plurality of discrete values for each at least one secure print variable.

Additional features and advantages of the invention will be apparent from the following detailed description which illustrates, by way of example, features of the invention.

DETAILED DESCRIPTION OF THE PREFERRED EMBODIMENT(S)

Before particular embodiments of the present invention are disclosed and described, it is to be understood that this invention is not limited to the particular process and materials disclosed herein as such may vary to some degree. It is also to be understood that the terminology used herein is used for the purpose of describing particular embodiments only and is not intended to be limiting, as the scope of the present invention will be defined only by the appended claims and equivalents thereof.

In describing and claiming the present invention, the following terminology will be used.

The singular forms "a," "an," and "the" include plural referents unless the context clearly dictates otherwise. Thus, for example, reference to "a variable" includes reference to one or more of such variables.

As used herein, "secure print technology" is any printing technology that has at least one variable printing aspect that can be utilized to assist in authenticating a target item. Such technologies may include, without limitation, printing a variable number of lines in a series, varying line thickness, relative image placement, variable text printing, variable color printing, covert printing technologies such as invisible or fluorescent ink, etc.

As used herein, "secure print variable" includes any printable variation in a secure print technology that can be utilized to assist in authenticating a target item. These variables may include, without limitation, line thickness, distance between printed objects, text or line color, hue, intensity, invisibly printed words, fluorescent printing wavelength, font sizes, etc.

As used herein, a "plurality of discrete values" includes a group of distinct or discrete values that can reasonably be uniquely measured within a secure print variable range.

As used herein, a "single value" is a single discrete value from the plurality of discrete values. For example, if a plurality of discrete values numbers from 1 to 100, a single value may be 19.

As used herein, "overt" or "overt printing" may be used interchangeably, and refer to print markings that are obvious to an observer. Examples may include, without limitation, font sizes, line widths, rectangle hue, etc.

As used herein, "covert" or "covert printing" may be used interchangeably, and refer to print markings that are not obvious to an observer. Examples may include, without limitation, invisible printing, fluorescent printing, microtext, etc.

As used herein, "target item" or "product" may be used interchangeably, and refer to an item that is susceptible to counterfeiting. References to printing or marking on a target item or product would also include printing or marking on a label or other packaging material to be affixed to or encase the target item or product.

In accordance with the present invention, a method for implementing a secure printing campaign to thwart counterfeiting is provided. In one embodiment, the method may include steps of selecting a first secure print technology and a second secure print technology distinct from the first secure print technology, selecting a first secure print variable for the first secure print technology and a second secure print variable for the second secure print technology, and establishing a first plurality of discrete values for the first secure print variable and a second plurality of discrete values for the second secure print variable.

The method may further include selecting a first single value from the first plurality of discrete values and a second single value from the second plurality of discrete values, and printing a first marking and a second marking on a target item, where the first marking is defined by the first single value, and the second marking is defined by the second single value. Additionally, a key may be established which includes an identification of the target item, the first marking, and the second marking. Upon matching the key with the target item, the target item is authenticated. As such, detecting a purported target item and detecting both the first single value and the second single value from the purported target item authenticates the purported target item as an authentic target item.

In one aspect, the first secure print variable and the second secure print variable can be the same. For example, if the first secure print technology is a printed graphic line, and the second secure print technology is a printed line of text, the first secure print variable and the second secure print variable would be the same if they both represented the color of the line or the text. In another aspect, the first secure print variable and the second secure print variable can be different from each other. Following the same example as above, the first secure print variable and the second secure print variable would be different if the first represented the color of the line and the second represented the font size of the text. In another aspect, at least one of the first secure print variable or the second secure print variable can be a multi-dimensional variable.

In another aspect, the step of establishing a first plurality of discrete values and a second plurality of discrete values can include a preliminary step of determining a range encompassing at least one of the first secure print variable or the second secure print variable. Determining a range for a secure print variable may allow the estimation of the maximum number of discrete values available for that secure print variable.

In another aspect, a first single value can be selected from the first plurality of discrete values and a second single value can be selected from the second plurality of discrete values. A first marking defined by the first single value and a second marking defined by the second single value can then be printed on a target item. In other words, a marking would be defined by the corresponding single value. If the secure print technology was a printed line of text, and the secure print variable was font size, the marking would be a line of text with a font size defined by the print variable. If the single value for that secure print variable was 12, then the line would be printed with a font size of 12. Markings may be either covert markings, overt markings, or both.

Authenticating a target item as a genuine, non-counterfeited product can be accomplished by detecting what is purported to be a genuine target item, and then detecting both the first single value and the second single value from the purported target item. The purported target item can be authenticated as a genuine target if the detected values match with a key that includes identification of the target item, the first marking, and the second marking.

In another embodiment, a method for implementing a secure printing campaign to thwart counterfeiting may include steps of selecting three or more secure print technologies, selecting at least one secure print variable for each of the secure print technologies, and establishing a plurality of discrete values for each at least one secure print variable. The various secure print variables can each be different from one another, and a secure print variable can be a multi-dimensional variable. In one aspect, a single value can be selected from each plurality of discrete values associated with each secure print variable, and a plurality of markings can be printed on a target item, with each marking being defined by a corresponding single value. As discussed above, markings can either be covertly or overtly printed.

A single value can be selected from each plurality of discrete values, and a plurality of markings may be printed on a target item, with each marking being defined by a corresponding single value. A key can be established which includes identification of the target item and the plurality of markings. Upon matching the key with the target item, the target item is authenticated. As such, detecting a purported target item and detecting enough single values from the purported target item authenticates the purported target item as an authentic target item. The number of differently-determinable single values that make up the plurality of discrete values may be dependent on the creation device, the authentication device, the validation software, and/or the algorithm used to determine the "step size" between each single value. In other words, the printer used to create the plurality of markings, the scanner used to detect the markings, the validation software used to verify the authenticity of the markings, and/or the algorithm used to establish the plurality of discrete values may determine how many distinct single values can be measurably detected within the range of the secure print variable.

In another aspect, similar to that discussed above, the step of establishing a plurality of discrete values for each secure print variable can include a preliminary step of determining a range encompassing the secure print variable. Determining a range for a secure print variable may allow the estimation of the maximum number of discrete values available for that secure print variable.

As discussed above, authenticating a target item as a genuine, non-counterfeited product can be accomplished by detecting what is purported to be a genuine target item, and then detecting enough single values from the purported target item to allow authentication. The purported target item can be authenticated as a genuine target if the detected single values match with a key that includes identification of the target item and the plurality of markings.

In another embodiment of the present invention, the step of printing a plurality of markings on a target item can further include creating a print template having a plurality of regions configured to accept variable data items, generating a plurality of variable data items, wherein each variable data item is derived from at least one single value, adding the plurality variable data items to the print template, and printing the print template. This embodiment describes a method of performing variable data printing (VDP). VDP provides a template with static or non-modifiable portions along with "copy holes" designed to accept data that is variable. Variable data items are generated as discussed herein, and can be inserted into the "copy holes" of the template to be printed.

In discussing the above described embodiments, it is not intended that the present invention be limited by the number of technologies used. The selection of various secure print technologies provides a printing campaign with sufficient variability to greatly increase the difficulty of counterfeiting a product. If a target item or product can be marked with a printing scheme having one million combinations, then a counterfeiter generating a counterfeited product has only a one in one million chance of getting the printing right. Printing campaigns utilizing the embodiments described in the present invention can greatly increase the total number of potential combinations of product markings by increasing the number of secure print technologies used. The total number of target item marking combinations is the product of each secure print technology. For example, if the number of discrete values for each of five secure print technologies in a particular print campaign are 30, 20, 10, 100, and 10, then the total number of product markings would be: 30*20*10*100*10=6 million.

Numerous secure print technologies can be selected for inclusion in a specific campaign. Examples will be given herein, which are not intended to be limiting in any way, but are merely used to illustrate the variability of secure print technologies that can be utilized in a given print campaign. Also, secure print technologies can be selected that require highly advanced, expensive printers to implement, especially secure print technologies that include microtext and precise color schemes. Subsequent attempts to scan and print these markings may fail due to the limited print capabilities of consumer ink jet and laser printers that are often used by many counterfeiters. As a result, a majority of counterfeiters can be thwarted by advanced print technologies. Additionally, the number of secure print technologies can be increased to reach any target number of combinations.

Color target: One secure print technology includes printing a rectangular, or other shaped target on the target item with particular measurable characteristics, such as hue. The various hues can be, for example, standard Macbeth color targets. Measurement of the particular hue can provide a level of variability for the secure print technology. Other characteristics that can be printed and measured using a rectangular or other shaped target include the saturation or intensity of a specific hue in the target, or particular percentages of pixels of black, white, or other hue in the target.

MTF pattern: Another secure print technology may include a modulation transfer function (MTF) pattern. Various MTF patterns can be utilized, which are well known to one skilled in the art. In one instance, an MTF pattern is a series of alternating black and white bands with a particular spatial frequency. The spatial frequency can be regular, i.e. the bands are uniformly spaced, or it may be irregular, including a systematic variation in band spacing, or even a random spacing of bands. Additionally, variations in the resolution of particular bands or all bands of the MTF pattern can provide an appropriate measurable secure print variable. In another instance, the MTF pattern can be essentially a grayscale image with a randomized, uncorrelated two-dimensional pattern. The entire pattern or a portion of the pattern can be measured for any number of characteristics. For example, a particular pixel pattern in a specific region may provide the authenticable characteristic. Additionally, the grayscale image has a uniform band-limited white-noise power spectral density (PSD). The PSD is only uniform, however, when measured across the entire pattern. Because of the random nature of the MTF pattern, localized regions will have a specific spectral density that is not uniform white-noise, and can thus be used to authenticate the pattern.

Lines with varying thickness: Variation in the thickness of lines printed on the target item can provide an appropriate secure print variable. The lines may be printed on the target item for the express purpose of verification, or they may be preexisting portions of the target item design. For example, line thickness in a preexisting design such as a corporate emblem may be altered for authentication purposes without affecting the overall look of the package. In designs that incorporate numerous lines, the thickness of different lines may be altered in different campaigns, thus increasing the difficulty for a counterfeiter to observe and duplicate the alteration. For example, current bar code systems use variable line thickness to encode salient information. A higher degree of variability may be achieved by having a range of maximum line thickness to minimum line thickness, e.g. 10 to 2 pixels, which can be generally differentiated at a large number of resolutions, so long as the scanner MTF can accommodate the line MTF, e.g., even if the lines are misregistered by 0.5 pixels, the gray values in the transition/edge pixels may help ascertain the original number of lines.

Lines of text: Variation in the font size of a particular line of text may also be utilized as an authentication measurement. Though a portion of a line can also have an altered font size, and thus be used to authenticate the package, this scheme may be less desirable as the alteration of only a portion of a line of text would be more obvious to the casual observer. The line of text used may be any text printed on the target item, including the name or address of the manufacturer, or specific lines, sentences, or paragraphs of text in a description or instruction section. Also, authentication of a line of text can be assessed by measuring particular characteristics of a single letter within that line. For example, the x-line, or the distance from the bottom to the top of a small "x," can be a means of assessing text size. Based on letter frequency and other concerns, e.g., the ease of height assessment for letters such as "z", the following letters may, for example, be used to assess x-line height: "e", "a", "o", "n", "s", "d", "p", "m", "z", "u", "r", "g" and "b".

Object placement: A secure print technology can also include the placement of a marking relative to one or more other markings. This may include any marking printed on the target item, including text and lines involved in the overall design. The placement information may be Cartesian coordinates, a vector, or any other means of measurement known to one skilled in the art. In various campaigns, the relative locations of these markings can be altered slightly to provide a different single value without necessarily tipping off the counterfeiter that there has been a change. As an example, a manufacturer's logo may be printed in a specific location relative to the intersection of two border lines of the design, or relative to a registered trademark symbol associated with the product name. Small movements of the logo in alternate campaigns can also provide a new authentication measurement.

Various other secure print technologies may include a sequence of lines with variable numbers, thicknesses, colors, separation distance, length, specific curvatures, etc.

Numerous covert secure print technologies can also prove useful in a printing campaign, such as invisible inks, fluorescence, microtext, and various copy detection patterns. Copy detection patterns include printing technologies that decrease in entropy or degrade when copied. These technologies are useful in detecting if the markings on a particular product have undergone photocopying. Additionally, covert and overt technologies can be combined to produce product markings containing visual and non-visual elements. One example may be a vertical black bar with a specific thickness, having a number of horizontal fluorescent lines printed across it. Numerous combinations would be apparent to one skilled in the art once in possession these embodiments, and are considered to be within the scope of the present invention.

Turning to the establishment of a plurality of discrete values for each secure print variable, the following descriptions are not intended to be limiting. In order to determine the variability of a secure print technology, the number of discrete values available for each secure print variable of that technology is determined. One method to accomplish this is a 6-sigma determination. With this method the number of discrete values that can be measured in a given range is calculated. This may include, for example, the number of discrete hues in a colored rectangle, the number of discrete thicknesses in a line, or the number of discrete vectors between two printed objects. It is important to note that what defines the number of discrete values depends on the resolution of the detector. In the case of a system utilizing a spectrophotometer, the number of discrete measurements would be related to the resolution of the device, and how accurately the system utilizing the device can discriminate differences in values within the range. This is also true of scanners, and will, in addition, depend on the color space and color representation used (e.g. RGB, CMYK, HIS, Lab, Luv, etc.). Printing capability also may be an important factor in this determination. If the detection system is visual discrimination by a human, the number of discrete values would be related to what extent that human could discriminate differences in values within the range. In comparing the previous examples, it is apparent that the number of detectable discrete values in a given range would be different between the two. As a result, the following calculations would depend on the particular detection system being utilized.

Two methods of determining the number of discrete values in a range using a 6-sigma calculation will be described: a sequential method and a coincidental method. These two methods are not intended to be limiting in any way, and it should be understood that alternative methods for calculating variability may be apparent to one skilled in the art and would be considered to be within the scope of the present invention. In the sequential method, sample point 1 is chosen, which may be at one end of the range for the secure print variable being measured. A meaningful number of samples corresponding to a discrete value at sample point 1 are printed, e.g., 20 to 30 for which the standard error of the mean is approximately 0.2 sigma. The mean and standard deviation for the samples are then calculated. For multi-dimensional variables, the standard deviation is calculated in each dimension. A 12-sigma value is calculated at the first point (i.e., 6-sigma on either side of sample point 1). A 12-sigma value would equal the standard deviation (sigma) multiplied by 12. Sample point 2 is then selected by moving the 12-sigma value along the range from sample point 1. A meaningful number of samples are printed, and the 12-sigma value is calculated at sample point 2 as described above for sample point 1. A mean of the 12-sigma values for sample point 1 and sample point 2 is calculated, and the location of sample point 2 along the variable range is back-corrected to this value. The location of a third sample point is then calculated by adding the 12-sigma value of sample point 2 to the mean of the 12-sigma values for sample points 1 and 2. The process is continued as described for the entire range of the secure print variable.

The following is an illustrative example of the sequential method:

Variable range: 0-100

First sample point: location=0; sigma=0.5; 12-sigma=6.0

Second sample point: location=6.0; sigma=0.4; 12-sigma=4.8

The first sample point is located at 0 along the range. Samples are printed of the sample corresponding to the discrete value at that point (i.e., 0), and the sigma is calculated to be 0.5. The 12-sigma value for sample point 1 is calculated by multiplying 0.5 by 12, resulting in a 12-sigma value for sample point 2 of 6. Samples are printed of the corresponding discrete value at the second sample point (i.e., 6), and the sigma is calculated to be 0.4. The 12-sigma value for sample point 2 is calculated by multiplying 0.4 by 12, resulting in a 12-sigma value for sample point 2 of 4.8. A mean of the 12-sigma values for the two points is then calculated: (6.0+4.8)/2=5.4. The location of sample point 2 is then back corrected from 6.0 to 5.4. The location of sample point 3 is then determined by adding the 12-sigma value of sample point 2 to the mean of the 12-sigma values for sample points 1 and 2: 4.8+5.4 =10.2. The process is then repeated for the duration of the range. In this example, if we assume 6-sigma values with a mean of 5.0 across the range, then there would be 21 discrete values corresponding to the secure print variable in the range between 0 and 100.

The coincidence method allows the entire range of the secure print variable to be evaluated in one print-scan iteration. Here a small difference between sample points is selected that is smaller than any 12-sigma value across the range. Subsequent sample point locations are calculated by adding the small difference to the previous sample point. Sample points in this method are not back-corrected. A total of the number of 12-sigmas at a particular sample point is calculated by dividing the small difference by the mean of the particular sample point location and the location of the previous sample point. When these calculations are performed across the entire variable range, the total of the number of 12-sigmas gives an approximation of the number of discrete measurements in the range.

The following is provided as an example of the coincidence method:

| Sample point | location | # of 12-sigmas to this point |
|---|---|---|
| 0 | 6.0 | 0 |
| 2 | 5.8 | 2/(5.9) = 0.34 |
| 4 | 5.1 | 2/(5.45) + 0.34 = 0.71 |
| 6 | 4.8 | 2/(4.95) + 0.71 = 1.11 |
| . . . | . . . | . . . |
| 100 | 4.4 | 2/(4.15) + 18.33 = 18.81 |

The integer value of 18.81 is 18, so the total number of estimated discrete values from 0-100 for this variable is 19 (i.e., sample point 1 started at zero).

This technique generally results in a number of discrete values that is similar to that of the sequential method, although in many cases it is more accurate, and it is often easier to perform. Additionally, the technique described in the coincidence calculation method can readily be extended to multiple dimensions and increased in sophistication using other forms of interpolation known to one skilled in the art, such as cubic spline fitting.

Turning to the authentication of a target item, various combinations of secure print technologies can provide a vast number of marking combinations that can deter counterfeiters and yet can be readily authenticated. The actual information regarding what secure print technologies are being used in a given campaign, what variables are being measured, and what combination of single values are required for authentication can be kept secure at the printing site or other secure location. The target item can be authenticated remote from the secure location by means of a specialized scanning device that is in communication with the secure location. Additionally, in the case of a public emergency or drug recall in the case of pharmaceuticals, the secure information can be published to rapidly disseminate it to the public. A visible unique number on the target item can be associated with the printing campaign used, and the number can be compared with published authentication information. It should be noted that utilizing such a "recall enabler" will reduce the actual number of different combinations available for a given secure print technology, which may be accounted for in the campaign planning stage.

As an example, the following XML based information can be stored on a secure server and associated with an individual package:

```
<package product = "xyz drug product" lot = "X182Hse34">
  <visible ID>4fRtt234</visible ID>
  <print technology>
    <text color sequence>
      <word>Ingredients</word>
      <sequence>CMYKXXXCMYK</sequence>
    </text color sequence>
  </print technology>
  <!other print technologies here>
</package>
```

In this example, the print technology varies the color of the letters in the word "Ingredients" on the package. The letters "Ingr" are colored cyan, magenta, yellow, and black respectively. The letters "edi" are colored any of these colors, signified by the random color identifier "X." The letters "ents" are colored cyan, magenta, yellow, and black. The variability of the eight letters used in this word and the four colors chosen is $4^8$, or 65,536.

What is claimed is:

1. A method implementing a secure printing campaign to thwart counterfeiting, comprising steps of:

selecting a first secure print technology and a second secure print technology distinct from the first secure print technology;

selecting a first secure print variable for the first secure print technology and a second secure print variable for the second secure print technology; and establishing a first plurality of discrete values for the first secure print variable and a second plurality of discrete values for the second secure print variable;

selecting first single value from the first plurality of discrete values and a second single value from the second plurality of discrete values; and printing a first marking and a second marking on a target item, said first marking defined by the first single value, said second marking defined by the second single value.

2. The method of claim 1, further comprising the step of establishing a key which includes identification of the target item, the first marking, and the second marking such that, upon matching with the key, the target item is authenticated.

3. The method of claim 2, further comprising steps of:

detecting a purported target item; and detecting both the first single value and the second single value from the purported target item to authenticate the purported target item as the target item.

4. The method of claim 1, wherein the first secure print variable and the second secure print variable are the same.

5. The method of claim 1, wherein the first secure print variable and the second secure print variable are different.

6. The method of claim 1, wherein at least one of the first secure print variable or the second secure print variable is a multi-dimensional variable.

7. The method of claim 1, wherein the step of establishing a first plurality of discrete values and a second plurality of discrete values includes a preliminary step of determining a range encompassing at least one of the first secure print variable or the second secure print variable.

8. The method of claim 7, wherein at least one of the first plurality of discrete values or the second plurality of discrete values includes a maximum number of discrete values within the range.

9. The method of claim 1, wherein at least one of the first marking or the second marking is a covert marking.

10. The method of claim 1, wherein at least one of the first marking or the second marking is an overt marking.

11. A method implementing a secure printing campaign to thwart counterfeiting, comprising steps of:

selecting three or more secure print technologies;

selecting at least one secure print variable for each of the secure print technologies; and establishing a plurality of discrete values for each at least one secure print variable;

selecting a single value from each plurality of discrete values; and printing a plurality of marking on a target item, each marking defined by a corresponding single value.

12. The method of claim 11, further comprising the step of establishing a key which includes identification of the target item and the plurality of markings such that, upon matching with the key, the target item is authenticated.

13. The method of claim 12, further comprising steps of:

detecting a purported target item; and detecting enough single values from the purported target item to authenticate the purported target item as the target item.

14. The method of claim 11, wherein the at least one secure print variable for each of the secure print technologies are each different.

15. The method of claim 11, wherein at least one of the secure print variables is a multi-dimensional variable.

16. The method of claim 11, wherein the step of establishing a plurality of discrete values for each at least one secure print variable includes a preliminary step of determining a range encompassing each at least one secure print variable.

17. The method of claim 16, wherein at least one of the plurality of discrete values includes a maximum number of discrete values within the range.

18. The method of claim 11, wherein the step of printing a plurality of markings on a target item further includes steps of:

creating a print template having a plurality of regions configured to accept variable data items;

generating a plurality of variable data items, wherein each variable data item is derived from at least one single value;

adding the plurality variable data items to the print template; and printing the print template.

19. The method of claim 11, wherein at least one of the plurality of markings is a covert marking.

20. The method of claim 11, wherein at least one of the plurality of markings is an overt marking.

* * * * *

UNITED STATES PATENT AND TRADEMARK OFFICE

CERTIFICATE OF CORRECTION

PATENT NO. : 7,455,013 B2
APPLICATION NO. : 11/076533
DATED : November 25, 2008
INVENTOR(S) : Steven J. Simske et al.

It is certified that error appears in the above-identified patent and that said Letters Patent is hereby corrected as shown below:

In column 9, line 52, in Claim 1, after "selecting" insert -- a --.

In column 10, line 24, in Claim 11, after "technologies;" delete "and".

In column 10, line 29, in Claim 11, delete "marking" and insert -- markings --, therefor.

Signed and Sealed this

Eleventh Day of August, 2009

David J. Kappos

David J. Kappos
*Director of the United States Patent and Trademark Office*